United States Patent [19]

Gibello

[11] Patent Number: 4,478,416

[45] Date of Patent: Oct. 23, 1984

[54] TENNIS RACQUET WITH OFFSET, OVAL-SHAPED HEAD

[76] Inventor: Carlo Gibello, Corso Vittorio Emanuele 5, Torino, Italy

[21] Appl. No.: 414,172

[22] Filed: Sep. 2, 1982

[30] Foreign Application Priority Data

Sep. 4, 1981 [IT] Italy ..... 53581/81[U]

[51] Int. Cl.[3] ..... A63B 49/02

[52] U.S. Cl. ..... 273/73 C; D21/212

[58] Field of Search ..... 273/73 L, 73 C, 73 R, 273/73 J, 29 R, 29 A, 67 B, 67 R, 76; D21/210–212

[56] References Cited

U.S. PATENT DOCUMENTS

| | | | |
|---|---|---|---|
| 2,211,587 | 8/1940 | Thompson | 273/73 G |
| 3,545,755 | 12/1970 | Owada | 273/73 J |
| 3,801,099 | 4/1974 | Lair | 273/73 C |
| 4,131,278 | 12/1978 | Goldenberg | 273/67 R |
| 4,147,348 | 4/1979 | Lee | 273/73 C |

FOREIGN PATENT DOCUMENTS

| | | | |
|---|---|---|---|
| 2610872 | 9/1977 | Fed. Rep. of Germany | 273/76 |
| 2407725 | 7/1979 | France | 273/76 |

*Primary Examiner*—Richard C. Pinkham
*Assistant Examiner*—Matthew L. Schneider
*Attorney, Agent, or Firm*—Sughrue, Mion, Zinn, Macpeak & Seas

[57] ABSTRACT

A tennis racket is provided in which the longitudinal axis of the shaft of the racket forms respective complementary angles of between 40° and 50° with the major axis and the minor axis of the racket head. The head of the racket is oval in shape and the head's geometric center is approximately aligned with the longitudinal axis of the shaft and handle so as to better position the sweet spot of the racket. The racket also includes an apertured rib which extends between the handle and the head.

8 Claims, 5 Drawing Figures

Figure 2:
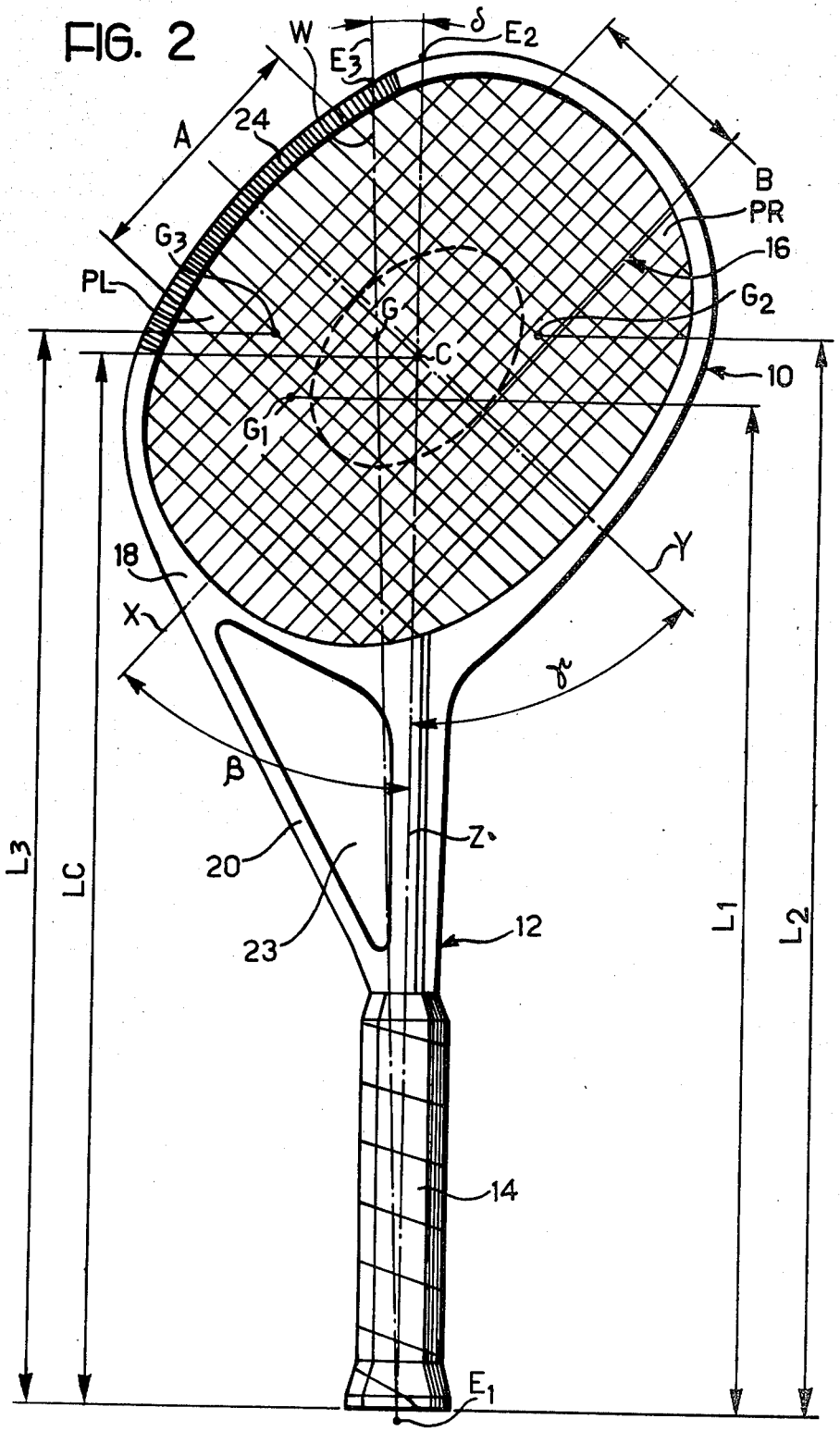

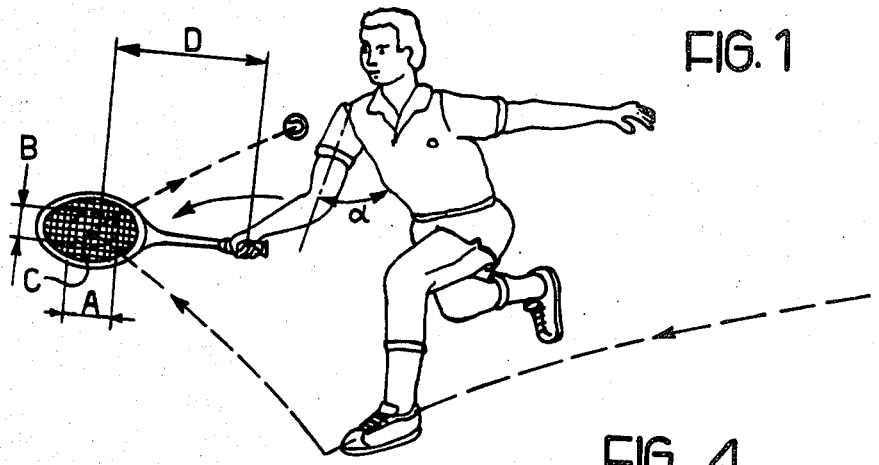
FIG. 1
FIG. 4
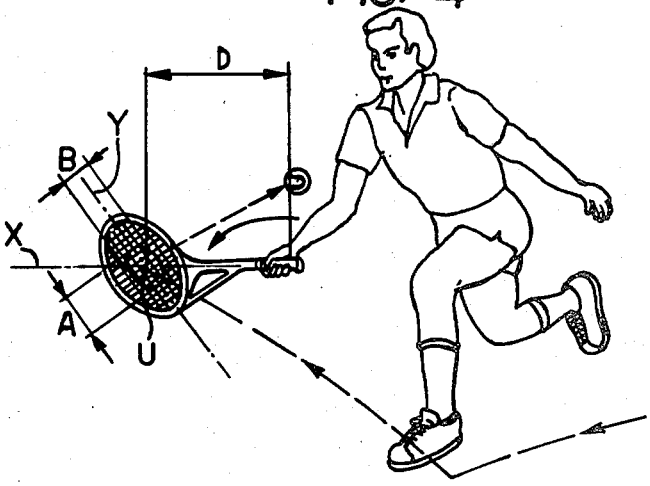
FIG. 5
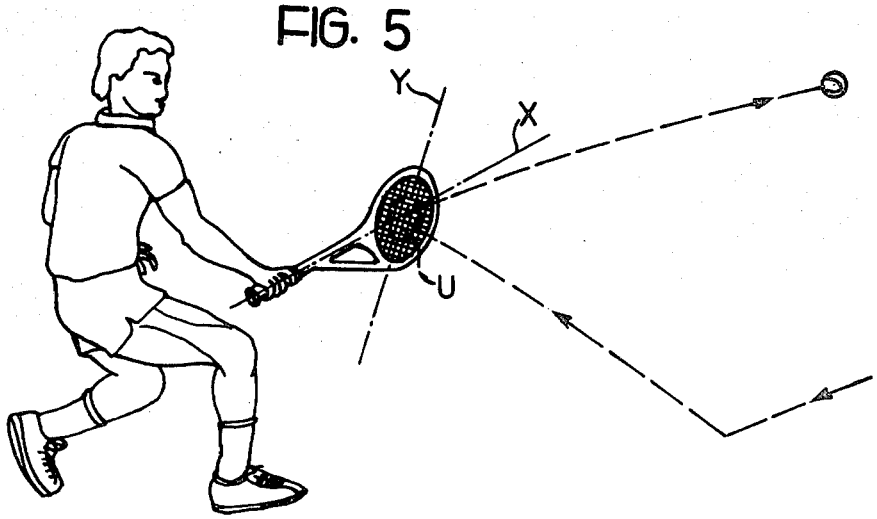

TENNIS RACQUET WITH OFFSET, OVAL-SHAPED HEAD

The present invention relates to tennis rackets.

Conventional tennis rackets comprise a frame constituted essentially by a straight shaft and a substantially oval head across which are tensioned the stringing. The major axis of the head coincides with the longitudinal axis of the shaft.

This conventional configuration does not allow optimum delivery to be achieved both from an ergonomic point of view, that is relative to the movements of the player, and from a technical and functional point of view at the moment of impact with the ball.

FIG. 1 of the appended drawings is a pictorial representation of a classic forehand stroke carried out with a conventional racket.

The sweet spot of impact with the ball is indicated U. By sweet spot is meant that zone of the stringing within which the ball is required to impact since outside this zone the stroke would be imprecise and without any efficacy.

The sweet spot U is normally oval, centred on the longitudinal axis or major axis of the stringing and slightly displaced towards the shaft relative to the transverse axis or minor axis of the stringing, to an extent which can vary from one type of racket to another. The area of the sweet spot U is about one fifth of the area of the complete oval of the racket.

The manner in which the sweet spot U of the conventional rackets normally works at the moment of impact with the ball will now be examined.

The case will be considered of a player who grasps the racket with his right hand as in FIG. 1. A player, in the act of hitting the ball, does not usually have any difficulty in positioning the racket instinctively at a point of intersection with the trajectory T of the ball and is therefore readily able to regulate the magnitude D, which is the distance between the hand and the centre of the sweet spot, that is, the optimum distance between the hand and the zone of impact. In this positioning the player is helped by the fact that the sweet spot U is oval and has its greater dimension A aligned with the shaft and disposed almost horizontally.

The player has much greater difficulty in centring the minor dimension B of the sweet spot U, not only because this dimension B is relatively small, but particularly because the centring with respect to the dimension B is more difficult to control because of the angle at which the arm and the hand of the player have been placed for this particular type of stroke. To this difficulty must be added the fact that the ball is rarely hit without tangential effects of the strings on the ball itself (37 lift' of "chop"), so that there exists the further difficulty, for the usual construction of racket, of an effectively narrower sweet spot whereas it would indeed be desirable to have a wider one.

On this subject it should be noted that all tennis manuals and all tennis coaches recommend that the so-called head or blade of the racket be held high since this improves the relative position between the axis of the trajectory of the approaching ball and the sweet spot U of the racket. In other words, with the head of the racket held high, the dimension A tends to rotate relative to the horizontal, that is, to increase the vertical width of the sweet spot.

The said head-high position of the racket is not however instinctive because of the natural conformation of the arm and the wrist and because of the fact that at least 80% of the balls must be hit at a distance from the ground not greater than about 50–70 cm, so that the correct position necessary for the player is one of standing with the knees bent at all times (a further recommendation of the manuals and of tennis coaches) and of drawing in the elbow so as to achieve an optimum angle $\alpha$.

In essence, conventional rackets do not have the oval sweet spot U of the stringing in the optimum position for extracting from the racket the maximum control and range of delivery at the moment of impact with the ball and hence constrain the player to put his arm and wrist at inclinations which impair the delivery from an ergonomic point of view. As is known, the human arm gives its maximum delivery with the minimum force for "thrown" strokes (that is, strokes effected with rotation of the shoulders and of the chest) when it is almost completely extended and when the angle $\alpha$ is not greater than 45°.

The object of the invention is exactly that of eliminating the said disadvantages.

In order to achieve this object, the invention provides a tennis racket constituted by a frame with a substantially oval strung head, having mutually perpendicular major and minor axes which intersect at a geometric centre of the head, the head having two opposed ends on its major axis, and with a straight shaft one end portion of which remote from the head is formed with a hand grip, the shaft and the hand grip having a longitudinal axis, characterised in that the longitudinal axis of the shaft and hand grip forms respective complementary angles of between 40° and 50° with the major axis and the minor axis.

The advantages of the invention will be clarified in the part of the description relating to FIGS. 4 and 5. For now it will suffice to note that a racket according to the invention allows the player to hold the head of the racket at the optimum height and in the optimum arrangement while at the same time keeping the correct angle $\alpha$ of FIG. 1.

Tennis rackets have already been proposed in which at least a certain part of the shaft forms a small angle with the major axis of the head.

Examples of rackets of this type are found in U.S. Pat. Nos. 3,545,755 and 4,147,348.

In the racket of U.S. Pat. No. 3,545,755 the shaft, which is not completely straight, forms a small angle, indicated by $\alpha$ in this document, of the order of a few degrees with the major axis of the oval of the head. A small angle does not resolve the problem of the invention and results in the racket handling in an effectively conventional manner with regards to the height and inclination of the head.

In document U.S. Pat. No. 4,147,348, the shaft forms an angle, indicated $\beta$ in this document, of about 5° with the major axis of the head, but the hand grip is in its turn at an angle, indicated $\theta$ in the document of 148°±4°. With this geometry it is even more difficult to hold the racket with its head high. It is necessary only to look at FIG. 1 of the document U.S. Pat. No. 4,147,348 to appreciate that, even if the player can hold his arm at a good angle, the angling of the hand grip relative to the shaft, causes the head of the racket to be irremediably lower than that of a conventional racket.

Figure 3:
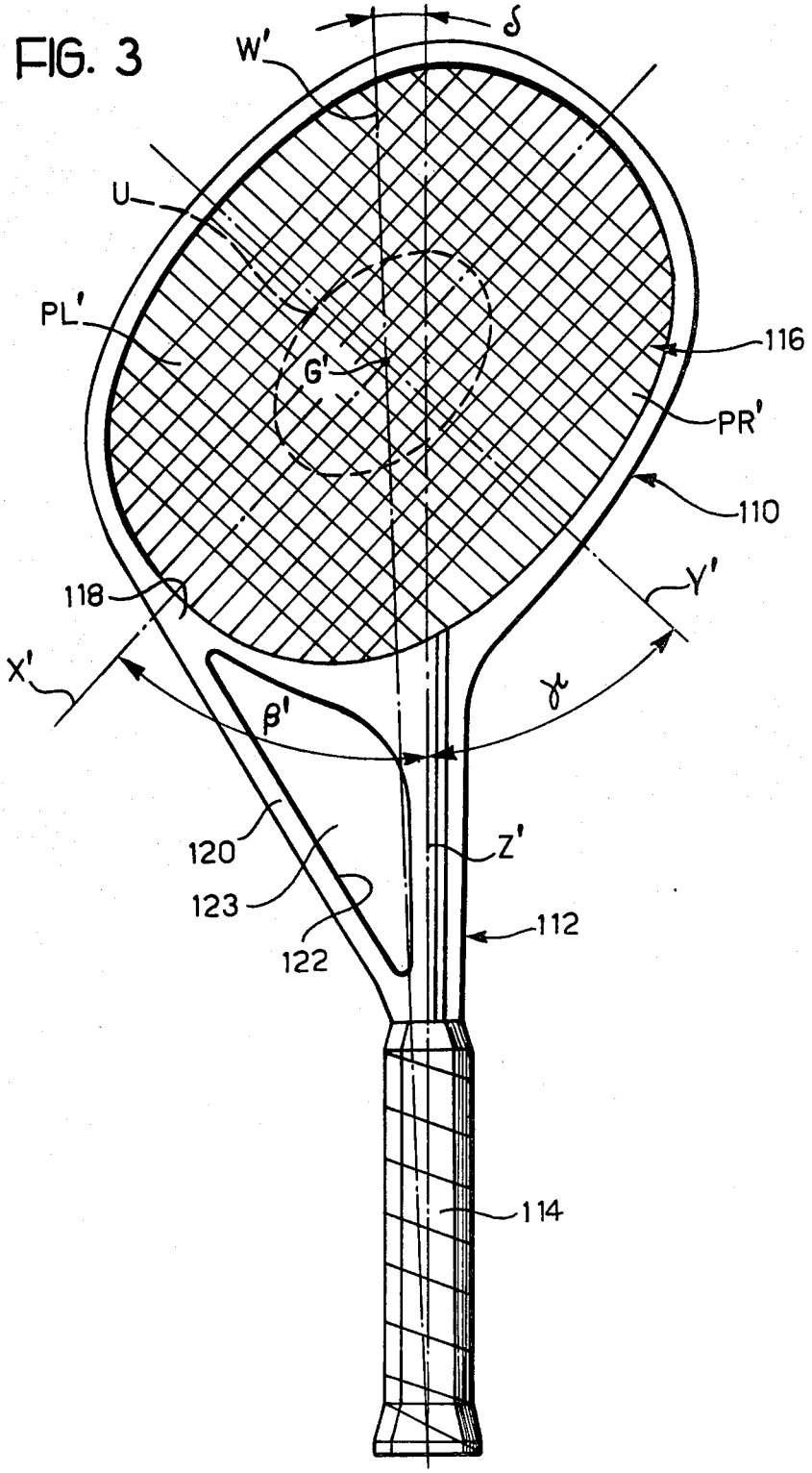

The invention will now be described with reference to FIGS. 2 to 5 of the appended drawings, in which:

FIGS. 2 and 3 are elevational views of two respective preferred embodiments of the racket according to the invention, and FIGS. 4 and 5 are respective pictorial representations of a forehand stroke and of a backhand stroke carried out with the racket of FIG. 2 or FIG. 3.

Referring to FIG. 2, a tennis racket according to the first embodiment of the invention is constituted by a frame with a substantially oval head 10 and a straight shaft 12 the end portion whereof remote from the head 10 is formed with a covering hand grip 14.

Both the shaft 12 and the head 10, which are integral with each other, may, when considered in isolation from each other, have any structure and any configuration such as those of conventional rackets.

X and Y indicate respectively the major axis and the minor axis of the head 10. The axes X and Y are perpendicular to each other and intersect at the geometric centre C of the head 10.

The longitudinal axis of the shaft 12 and of its hand grip 14 is indicated Z.

The salient difference, which characterises the racket of FIG. 2 over conventional rackets, is the fact that the axis Z forms respective angles $\beta$ and $\gamma$ of between 40° and 50° with the axis X and Y. Preferred values of these angles will be mentioned below.

The stringing 16 stretched across the head 10 is arranged conventionally, being constituted by crossed strings extending parallel to the major and minor axes X, Y.

The oval sweet spot of the stringing has again been indicated by U in FIGS. 3 to 5. The larger dimension of this sweet spot U is again indicated by A and the smaller dimension is again indicated by B.

The distance between the centre of the sweet spot U and the free end of the shaft 12 has been shown by LC. The magnitude of LC should also be within the range of values adopted for conventional rackets.

As can be seen, in a racket according to the invention, the end 18 of the head 10 which is closest to the shaft 12 is offset by a rather large amount relative to the shaft 12. As a result, it is preferable for the connection between the shaft 12 and the head 10 to be reinforced by a rib 20 extending obliquely from the region of the shaft 12 closest to the hand grip to the region of the end 18. For the purpose of lightness and to avoid useless air friction, the rib 20 is apertured, as indicated at 23.

In the embodiment of FIG. 2, the longitudinal axis Z passes at least substantially through the geometric centre C of the head.

It has however been found that the axis of longitudinal equilibrium of the racket, indicated by W, need not coincide with the axis Z.

In the embodiment of FIG. 2, the axis Z subdivides the head 10 into two parts PL, and PR of equal area. Supposing for the moment that these two parts PL and PR have the same weight and therefore the axis Z is also the axis of longitudinal equilibrium of the racket.

Under these conditions, if a static test is carried out on the racket, by suspending it between the two pivot points $E_1$, $E_2$ with the axis Z horizontal, it is found that the racket is in neutral equilibrium about the axis Z, that is, it is perfectly balanced. However, for the particular oblique disposition of the head 10 relative to the shaft 12, if the two parts PL and PR have the same weight, their respective centres of gravity $G_1$ and $G_2$ are respectively closer and further from the handgrip 14.

It has been found that for this reason the parts PL and PR, although having the same weight, behave differently at the moment at which they make contact with the ball. In practice, the player, at each impact with the ball, feels a twisting effect on his hand even if the ball has hit the geometric and dynamic centre C of the stringing perfectly. It is thought that this is due to the difference in the inertial couples relative to the hand grip 14, the arms of which are indicated respectively at $L_1$ and $L_2$ ($L_1 < L_2$).

In order to eliminate this disadvantage, in the embodiment of FIG. 2, the part PL is given a greater weight, this being given to the periphery of the head, in the cross hatched zone 24, for example, the zone 24 may be made with a larger cross-section.

The presence of the heavier zone 24 causes a displacement of $G_1$ to $G_3$ such as to increase the arm $L_1$ to a value $L_3$ about equal to $L_2$ whereby the differences in the inertial couples mentioned above disappears.

The centre of gravity of the head 10 is displaced, with the increase in weight of the portion 24, to a point G adjacent the geometric centre C, but offset relative to the longitudinal axis Z of the shaft 12 to the same side as the end 18 of the head 10 which is closest to the shaft 12.

It has been found that, in order to eliminate the disadvantage mentioned above, the centre of gravity G should preferably lie on an axis of longitudinal equilibrium W which intersects the longitudinal axis Z at the free end of the hand grip 14, that is, at the point $E_1$, and which forms an angle $\delta$ of the order of 2° to 5° therewith.

The racket is then in neutral equilibrium about the axis W when suspended with this axis W horizontal between the two pivot point $E_1$, $E_3$.

Before the behaviour of the racket according to the invention during play is described, the second embodiment illustrated in FIG. 3 will be described briefly.

In FIG. 3, parts similar to those of FIG. 2 have been indicated by the same reference numerals increased by 100, while an apostrophe(') has been added to the reference letters.

Their description will not be repeated except to highlight the differences with respect to FIG. 2.

In FIG. 3, the advantageous displacement of the centre of gravity has been achieved without increasing the weight of any part of the structure but by modifying the geometry of the racket.

The geometric centre of the head 110, that is, the intersection of its two axes X' and Y' coincides with its centre of gravity G'. However, the centre of gravity G' is displaced to the left in FIG. 3 relative to the longitudinal axis Z' of the shaft 112 on the same side as the end 118 of the head 110 which is closest to the shaft 112.

The centre of gravity G' also lies on an axis of equilibrium W' which intersects the axis Z' at the free end of the hand grip 114 and forms therewith an angle $\delta'$ which is preferably of the order of 2° to 5°.

In other words, it is as if all the head 110 had been displaced further to the left in the Figure relative to the shaft. With this geometry the longitudinal axis Z' subdivides the head 110 into two parts PL' and PR' of which the part PL' has an area, and correspondingly a weight, which is greater than that of the part PR'.

The behaviour of the racket of FIGS. 2 and 3 during the basic strokes will now be examined.

FIGS. 4 and 5 show rackets which can be equally well that of FIG. 2 or FIG. 3.

A forehand stroke is shown in FIG. 4. It can be shown that for the same inclination of the arm and the wrist as in FIG. 1, that is, for the same angle $\alpha$, the sweet spot U has a larger dimension A in line with the incident and rebound trajectory T of the ball.

A backhand stroke is shown in FIG. 5. In this case the angle of the sweet spot U is even more favourable in that preparation for the stroke requires a bending of the elbow which makes the arm turn about the body of the player.

In essence, in almost all forehand and backhand strokes, with the said angles between 40° and 50°, the major axis of the sweet spot U is made to coincide, or is at least brought nearer to, the trajectory of a ball incident on the racket. From another point of view, the racket according to the invention may be considered as a so-called "oversize racket", in which, as is known, the sweet spot is increased relative to conventional rackets but in the case of the invention the sweet spot is only rotated to its optimum orientation.

A further advantage of the aforesaid angling with the strings oriented parallel to the major and minor axes of the head 10 or 110 and of the sweet spot U, is as follows: in conventional rackets most of the work is done by the strings parallel to the major axis, these strings being systematically displaced by tangential impacts with the ball and equally systematically spoiled and broken before the strings parallel to the minor axis which in these strokes are not under pressure. In a racket according to the invention, with the strings still oriented parallel to the two major and minor axes of the head 10 or 110, all the strings work in a balanced and uniform manner even in the various strokes with a "lift" and "chop" action, in that the ball hits the strings at a maximum angle of about 30° to the major axis of the sweet spot U.

It should be noted that due to its asymmetry, the racket according to the invention, will have a "sense of use", that is, it must be gripped with the end 18 or 118 facing downwardly.

In practical use, the racket according to the invention, will not behave any differently from conventional rackets during flat strokes (for example, for the first service ball), while it will offer considerable advantages with regard to the effectiveness of the stringing and the facility of execution of all strokes effected with anticipation (immediately after the return) or with the various tangential actions (which amount to a minimum of 80% in modern play).

The greatest efficiency of the racket according to the invention will be developed particularly when volleying or at the net, in that, as the head of the racket will normally be high (that is, always higher than the hand), the inclination of the arm will bring the racket to bear in the optimum conditions since it allows the sweet spot U to be presented to the best effect to the incident ball, particularly considering the fact that in these situations of play, the time available to the player to prepare for a stroke is reduced to a minimum so that the probability of hitting the ball outside the sweet spot U in the direction of the minor dimension B increases considerably.

A racket according to the invention can be "personalised" according to the stature of the player.

For a player of normal stature (1.70 m) angles of $\beta=\beta'=\gamma=\gamma'$ of 45° are foreseen.

For a tall player (1.80 m or more) angles of $\beta=\beta'$ of 50° and $\gamma=\gamma'$ of 40° are foreseen.

For a smaller player (1.60 m or less) angles of $\beta=\beta'$ of 40° and $\gamma=\gamma'$ of 50° are foreseen.

These different angles according to stature allow a taller or smaller player to keep the head of the racket inclined in the same manner as a player of normal stature would, notwithstanding that the hand of the three types of players are normally at different distances from the ground while obviously the ball which arrives from the opposing player does not take account of these differences.

I claim:

1. A tennis racket constituted by a frame with:

a strung head which is substantially oval and has a major axis and a minor axis perpendicular to each other and intersecting at a geometric centre of the head, the head having two opposed ends on its major axis, and a straight shaft having an end part remote from said head which is formed as a hand grip, the shaft and the hand grip having a common longitudinal axis passing substantially through said geometric centre of the head;

wherein the said longitudinal axis of said shaft and hand grip forms respective complementary angles of between 40° and 50° with the said major axis and with the said minor axis whereby upon gripping the racket for a normal ground stroke the major axis of said head will be angled upwardly.

2. A tennis racket according to claim 1, wherein the said head has a centre of gravity which is displaced relative to the said longitudinal axis of the shaft on the same side thereof as the said end of the head which is closest to the said shaft.

3. A tennis racket according to claim 2, wherein the centre of gravity of the head lies on a straight line of equilibrium which intersects the said longitudinal axis of the shaft at the end of the said hand grip remote from said head and which forms an angle of the order of 2° to 5° with said axis.

4. A tennis racket according to claim 1, wherein the said geometric centre of the head coincides with its centre of gravity.

5. A tennis racket according to any one of the preceding claims, wherein the said strung head has stringing constituted by crossed strings parallel to the said major and minor axes of the head itself.

6. A tennis racket according to any one of claims 1 to 4, wherein the frame includes an oblique reinforcing rib which is integral therewith, and which extends from a region of the shaft close to the said hand grip to a region of the head which corresponds to the said end closest to the shaft.

7. A tennis racket according to claim 6, wherein the said rib is apertured.

8. A tennis racket constituted by a frame comprising a strung head which is substantially oval and has a major axis and a minor axis perpendicular to each other and intersecting at a geometric centre of said head, said head having two opposed ends on its major axis and a straight shaft having an end part remote from said head which is formed as a hand grip, the shaft and the hand grip having a common longitudinal axis, wherein said longitudinal axis of said shaft and handgrip forms respective complementary angles of between 40° and 50° with said major axis and with said minor axis and wherein the centre of gravity of said head lies on a straight line of equilibrium which intersects said longitudinal axis of said shaft at the end of said hand grip remote from said head and which forms an angle on the order of 2°-5° with said axis.

* * * * *